US007886652B2

(12) United States Patent
Matsumoto et al.

(10) Patent No.: US 7,886,652 B2
(45) Date of Patent: Feb. 15, 2011

(54) POSITIONING CONTROL MECHANISM FOR SINGLE-ACTING AIR CYLINDER

(75) Inventors: Takumi Matsumoto, Tsukubamirai (JP); Kazuhiro Noguchi, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 405 days.

(21) Appl. No.: 12/047,692

(22) Filed: Mar. 13, 2008

(65) Prior Publication Data

US 2008/0236383 A1 Oct. 2, 2008

(30) Foreign Application Priority Data

Mar. 30, 2007 (JP) ..... 2007-091487

(51) Int. Cl.
*F15B 9/09* (2006.01)
*F15B 13/04* (2006.01)

(52) U.S. Cl. ..... 91/363 R; 91/403

(58) Field of Classification Search ..... 91/361, 91/363 R, 365, 392, 403
See application file for complete search history.

(56) References Cited

U.S. PATENT DOCUMENTS 4,510,849 A 4/1985 Khramtsov et al.
4,741,247 A 5/1988 Glomeau et al.
6,356,811 B1 * 3/2002 Beselt ..... 700/301

FOREIGN PATENT DOCUMENTS

| | | |
|---|---|---|
| DE | 196 13 029 | 7/1997 |
| JP | 57-501587 | 9/1982 |
| JP | 58-35001 | 3/1983 |
| JP | 59-3001 | 1/1984 |
| JP | 63-167102 | 7/1988 |
| JP | 9-190222 | 7/1997 |
| JP | 10-73102 | 3/1998 |

* cited by examiner

*Primary Examiner*—Michael Leslie
(74) *Attorney, Agent, or Firm*—Oblon, Spivak, McClelland, Maier & Neustadt, L.L.P.

(57) ABSTRACT

An electromagnetic operation-type automatic pressure-adjusting valve outputting an air pressure corresponding to an amount of electric power is connected in an air flow path connecting a pressure chamber of a single-acting main cylinder and an air source. A controller is configured to obtain a relationship between a position of a piston and an air pressure from a relationship between the position of the piston of the main cylinder and a spring force of a return spring, and a relationship between the air pressure supplied to the pressure chamber and an acting force applied to the piston by the air pressure. When a target position of a movement of the piston is inputted to the controller, the controller is operated to move the piston toward the target position and to stop the piston at the position by means of controlling the amount of electric power for the automatic pressure-adjusting valve so that an air pressure corresponding to the target position is outputted.

12 Claims, 6 Drawing Sheets

POSITIONING CONTROL MECHANISM FOR SINGLE-ACTING AIR CYLINDER

TECHNICAL FIELD

The present invention relates to a positioning control mechanism capable of arbitrarily controlling a positioning operation for a movement position of an air cylinder used for conveyance of a workpiece, or a chucking operation, a working operation, or the like for the workpiece, and in other words, it relates to a positioning control mechanism for an air cylinder capable of arbitrarily changing or adjusting a position of a point of a force applied to the workpiece, and more specifically, it relates to a control mechanism for a single-acting air cylinder.

BACKGROUND ART

Actuators used for work, such as conveyance of a workpiece, or a chucking operation, a working operation, or the like for the workpiece is operated by energy, such as an air pressure, a liquid pressure, electricity, and so forth. In the above-described actuators, although an electric actuator utilizing electric energy is advantageous at a point that a movement position thereof can be freely changed or adjusted, the structure thereof is complicated and specifically, in the electric actuator having a construction to obtain a linear movement, the structure thereof is further complicated. Furthermore, when large force of application is attempted to be obtained, growing in size of the actuator, and growing in electric power consumption thereof cannot be avoided. Hence, in a case that a constant stopping position of the actuator is retained, the electric power has to be continuously supplied in the meantime, and therefore a loss in view of energy saving is also large. Moreover, in a case that the force of application is added to a load via a rod or the like, not only a mechanical loss tends to be caused by that a power transmitting portion of the actuator directly receives an impact, but also there is a possibility that excessive repulsive force is applied to the load.

On the other hand, as an actuator utilizing the air, an air cylinder is well known. This air cylinder is that for converting energy of compressed air into a linear movement. There are a double-action air cylinder that is moving a piston by means of alternately supplying air into a pressure chamber at each of both sides of the piston, and a single-acting air cylinder that is moving a piston by means of air supplied to and discharged from a pressure chamber at one side of the piston and a spring force of a spring installed at the other side of the piston. Since in any one of these types of the air cylinders, the linear movement can easily be obtained in comparison with the electric actuator, the same is widely utilized for various operations.

However, in the air cylinders, ordinarily, a moving stroke of the piston is mechanically determined and the piston is configured to move between a position at an advancing end and a position at a retreating end that are regulated by a stopper or the like. Consequently, it is difficult to change or adjust the moving stroke (movement position) of the piston. Specifically, it is difficult to arbitrarily change or adjust the moving stroke of the piston. Hence, it is general to selectively use the air cylinders each having different moving strokes, corresponding to the work.

DISCLOSURE OF INVENTION

An object of the present invention is to enable a movement position of a piston in a single-acting air cylinder to be arbitrarily changed or adjusted corresponding to work by means of a simple positioning control mechanism using a pressure-adjusting apparatus.

In order to achieve the above-described object, the positioning control mechanism according to the present invention includes a pressure chamber and a return spring at either side of the piston, and the positioning control mechanism further includes a main cylinder of a single-action where the piston is moved by means of air pressure supplied to the pressure chamber and a spring force of the return spring, an air-supplying unit provided with an air source, the pressure-adjusting apparatus disposed between the air-supplying unit and the pressure chamber of the main cylinder, and a controller that electrically controls the pressure-adjusting apparatus.

The pressure-adjusting apparatus is formed of an electromagnetic operation-type automatic pressure-adjusting valve that outputs the air pressure corresponding to an amount of electric power.

Further, the controller is provided with an input device for inputting a target position of a movement of the piston. Furthermore, the controller is configured to obtain a relationship between the position of the piston and the air pressure from a relationship between the position of the piston and the spring force of the return spring, and a relationship between the air pressure supplied into the pressure chamber and acting force applied to the piston by the air pressure. When the target position of the movement of the piston is inputted by means of the input device, the controller is operated to move the piston toward the target position and to stop the piston at the position by means of controlling the amount of electric power for the automatic pressure-adjusting valve so that the air pressure corresponding to the target position is outputted.

In the present invention, it is preferable that a two-port-type electromagnetic valve for stopping the piston is connected in an air flow path that connects the pressure-adjusting apparatus and the pressure chamber of the main cylinder. Further, it is preferable that the two-port-type electromagnetic valve is on/off-controlled by means of the controller, and at the time when the piston is moved, the two-port-type electromagnetic valve is switched to an ON state resulting in opening the air flow path, and at the time when the piston is stopped, the two-port-type electromagnetic valve is switched to an OFF state resulting in sealing the air in the pressure chamber.

In the present invention, the main cylinder may be provided with a length-measuring sensor for measuring the movement position of the piston and feeding back a position signal to the controller.

In another positioning control mechanism according to the present invention, the pressure-adjusting apparatus is provided with a two-port-type supplying electromagnetic valve for either allowing the air to pass through an air flow path or not while being connected in the air flow path connecting the air-supplying unit and the pressure chamber, a two-port-type exhausting electromagnetic valve for either allowing the air to pass through or not between the pressure chamber and atmospheric air, and a pressure sensor for detecting an air pressure in the pressure chamber, and the controller is constructed to be provided with an input device for inputting a target position of a movement of the piston, and to obtain a relationship between the position of the piston and the air pressure from a relationship between the position of the piston and the spring force of the return spring, and a relationship between the air pressure supplied to the pressure chamber and acting force applied to the piston by the air pressure. When the target position of the movement of the piston is inputted with the input device, the two-port-type supplying electromagnetic valve and the two-port-type exhausting electromagnetic valve are on/off-controlled by means of the controller so that the air pressure in the pressure chamber detected by the pressure sensor is adjusted to a pressure corresponding to the target position of the piston, and thus the air pressure in the pressure chamber is adjusted. Thereby, the piston is moved toward the target position and is stopped at the position.

In the present invention, a single-acting slave cylinder that is connected to the pressure-adjusting apparatus in parallel with the main cylinder may be provided and the slave cylinder may be constructed to be position-controlled while synchronizing with the main cylinder by means of the controller via the pressure-adjusting apparatus.

In this case, a two-port-type stopping electromagnetic valve may be connected in the air flow path that connects the pressure-adjusting apparatus and the pressure chamber of the slave cylinder, and the two-port-type stopping electromagnetic valve may be controlled while synchronizing with a stopping electromagnetic valve that is connected to the main cylinder by means of the controller.

A regulator for maintaining the air pressure at a set pressure may be provided in the air-supplying unit.

According to the present invention, the movement position of the piston in the single-acting air cylinder can be arbitrarily changed or adjusted corresponding to the work without performing a mechanical adjustment or the like at all, by means of using a simple positioning control mechanism composed of the pressure-adjusting apparatus and the controller.

BEST MODES FOR CARRYING OUT THE INVENTION

Figure 1:
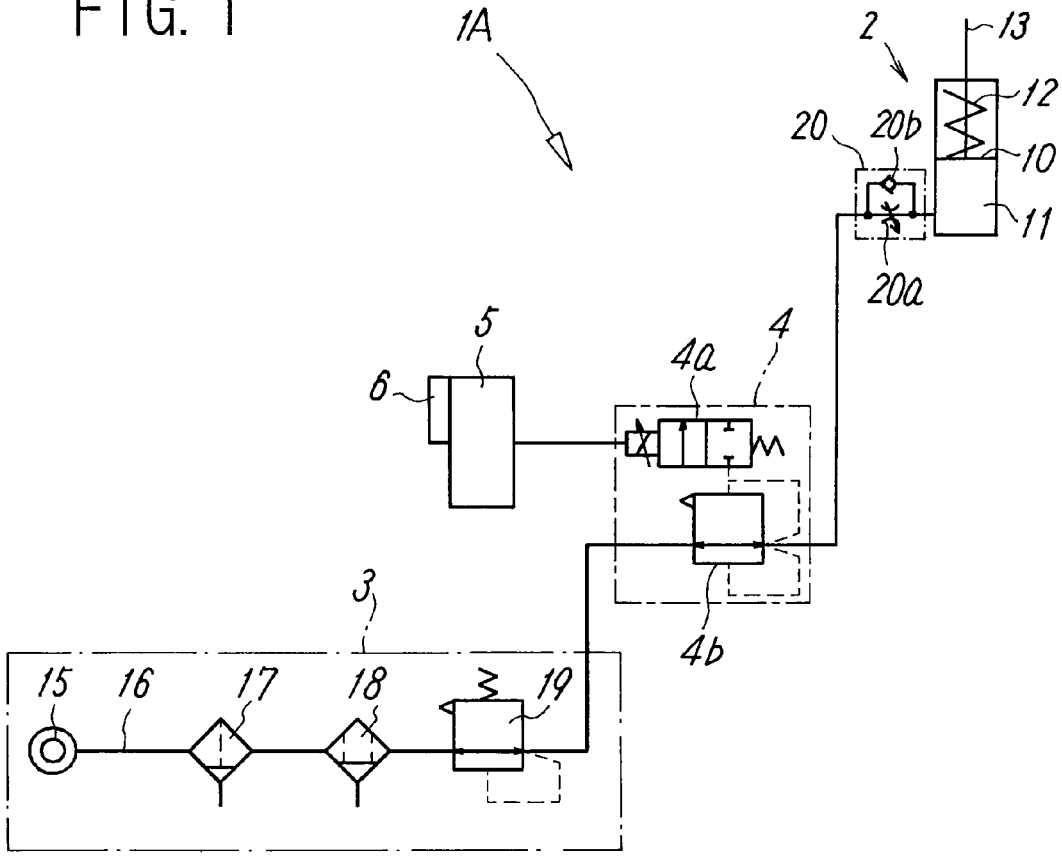
FIG. 1 is a hookup drawing illustrating a first embodiment of a positioning control mechanism according to the present invention.

A first embodiment of a positioning control mechanism for a single-acting air cylinder according to the present invention is illustrated with reference numerals in FIG. 1. In a positioning control mechanism 1A for a single-acting air cylinder of the first embodiment, reference numeral 2 denotes a main cylinder formed of a single-acting air cylinder, reference numeral 3 denotes an air-supplying unit for supplying pressurized air into the main cylinder 2, reference numeral 4 denotes a pressure-adjusting apparatus disposed between the air-supplying unit 3 and the main cylinder 2, and reference numeral 5 denotes a controller for electrically controlling the pressure-adjusting apparatus 4.

The main cylinder 2 is provided with a pressure chamber 11 at one side of a piston 10, and is provided with a return spring 12 at the other side thereof, and the piston 10 is configured to be linearly moved inside the main cylinder 2 by means of an acting force of the pressurized air supplied to the pressure chamber 11 and a spring force of the return spring 12. A rod 13 for work is coupled with one side of the piston 10, and the rod 13 is extended outside from a tip end of the main cylinder 2 and applies the acting force for conveyance of a workpiece, or a chucking operation, a working operation, or the like for the workpiece by means of contacting with the workpiece.

The air-supplying unit 3 is provided with an air source 15 for supplying the pressurized air, a filter 17 having a drain discharge portion, which is connected in order in an air flow path 16 that connects the air source 15 and the pressure chamber 11 of the main cylinder 2, an oil mist separator 18, and a regulator 19 for maintaining air pressure at a set pressure.

The pressure-adjusting apparatus 4 is formed of an electromagnetic operation-type automatic pressure-adjusting valve that outputs the air pressure corresponding to an amount of electric power, and the automatic pressure-adjusting valve is provided with a construction where a two-port-type electromagnetic proportional control valve 4*a* and a pilot operation-type pressure-reducing valve 4*b* are combined. Accordingly, the automatic pressure-adjusting valve is also indicated by the reference numeral 4 in the below described explanation.

The controller 5 is provided with an input device 6 for inputting a target position of a movement of the piston 10. Further, a relationship between a position of the piston 10 and the spring force of the return spring 12, and a relationship between the air pressure supplied to the pressure chamber 11 and the acting force applied to the piston 10 are memorized in the controller 5, while being digitized or anathematized in advance. According to the relationships, the relationship between the air pressure and the position of the piston 10 is obtained. Further, when the target position of a movement of the piston 10 is inputted into the controller 5 by means of the input device 6, the controller 5 calculates the air pressure corresponding to the target position from the relationship between the air pressure and the position of the piston 10. The controller 5 controls the amount of electric power of the automatic pressure-adjusting valve 4 so that the air of the calculated air pressure is outputted.

The air outputted from the automatic pressure-adjusting valve 4 flows into the pressure chamber 11 of the main cylinder 2 and works on the piston 10, and thereby moves the piston 10 toward the target position. Furthermore, when the piston 10 reaches the target position, the piston 10 stops at the position and the stopping state thereof is retained. This is because the acting force applied by means of the air and the spring force of the return spring 12 are balanced with each other.

In a case that the target position of the movement of the piston 10 is two in number, namely an advancing end and a retreating end, the controller 5 calculates two of a high air pressure and a low air pressure corresponding to the two of the target positions. The controller 5 controls the amount of electric power of the automatic pressure-adjusting valve 4 corresponding to these pressures. Thereby, the controller 5 moves the piston 10 between two of the target positions.

In this case, in an advancing process where the piston 10 moves from the retreating end toward the advancing end, the amount of electric power for the automatic pressure-adjusting valve 4 is increased and the high pressure air is outputted from the automatic pressure-adjusting valve 4. The piston 10 advances by means of the application of the high pressure air while compressing the return spring 12, and when the piston 10 reaches the target position and the acting force applied by means of the air and the spring force of the return spring 12 are balanced with each other, the piston 10 is stopped at the position.

Further, in a retreating process where the piston 10 moves from the advancing end toward the retreating end, the amount of electric power to the automatic pressure-adjusting valve 4 is reduced and the pressure of the air outputted from the automatic pressure-adjusting valve 4 is lowered. Hence, the piston 10 retreats by being pressed by the spring force of the return spring 12, and when the piston 10 reaches the retreating end and the acting force applied by means of the air and the spring force of the return spring 12 are balanced with each other, the piston 10 is stopped at the position.

A speed controller 20 that is constructed by connecting a variable throttle valve 20*a* and a one-way valve 20*b* in parallel is connected to the air flow path 16. This speed controller 20 adjusts a moving speed of the piston 10 by limiting a flow volume of the air that flows into the pressure chamber 11 or flows out from the pressure chamber 11 by means of the variable throttle valve 20*a*. However, the speed controller 20 does not always need to be provided.

Thus, in accordance with the positioning control mechanism, the movement position of the piston 10 in the single-acting air cylinder can be arbitrarily changed or adjusted corresponding to the work by a simple construction composed of the pressure-adjusting apparatus 4 and the controller 5, without performing a mechanical adjustment.

Figure 2:
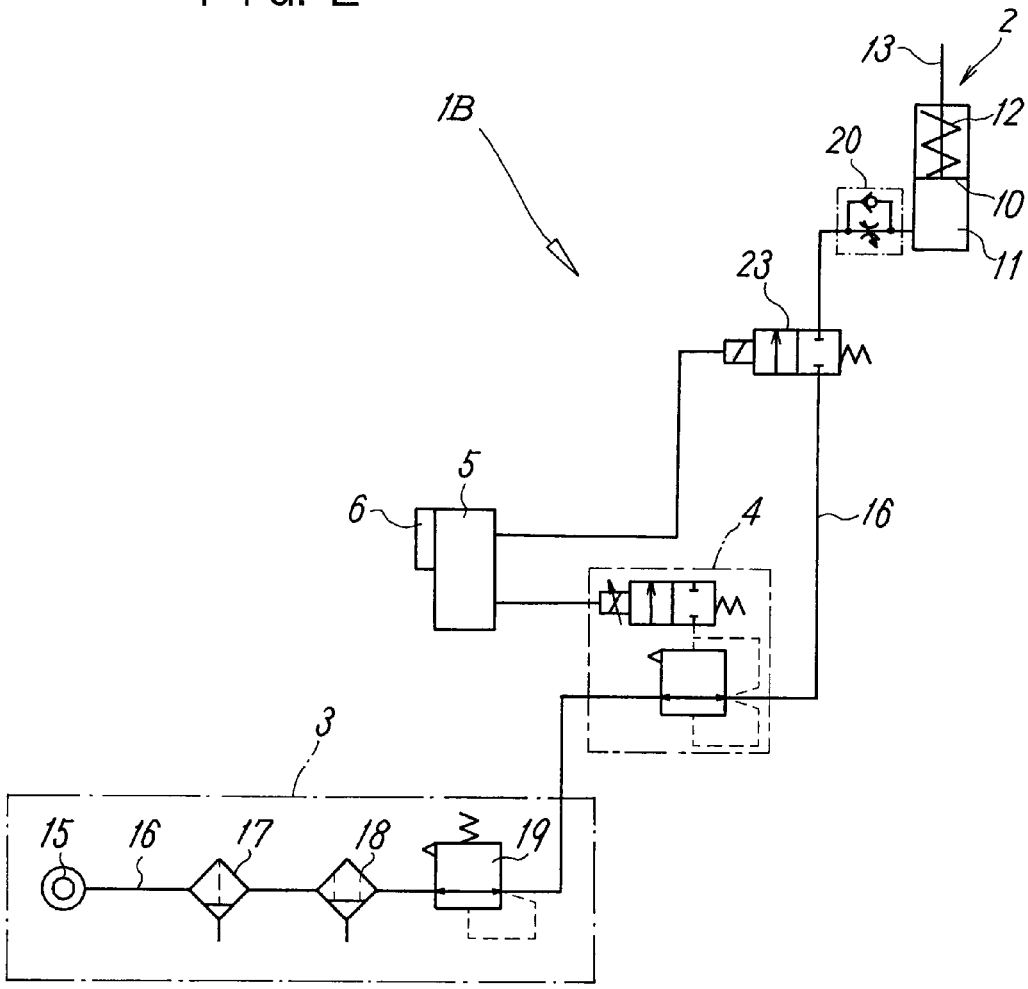
FIG. 2 is a hookup drawing illustrating a second embodiment of a positioning control mechanism according to the present invention.

A second embodiment of the positioning control mechanism according to the present invention is illustrated in FIG. 2. A positioning control mechanism 1B of the second embodiment is different from the positioning control mechanism 1A of the first embodiment by that a two-port-type main stopping electromagnetic valve 23 for either allowing the air to pass through an air flow path 16 or not is connected to the air flow path 16 connecting the pressure-adjusting apparatus 4 and the main cylinder 2.

The main stopping electromagnetic valve 23 is electrically connected to the controller 5 and the same is on/off-controlled by means of the controller 5. When the piston 10 is in the advancing process and the retreating process, the main stopping electromagnetic valve 23 is switched to an ON state and the air flow path 16 is brought to a state of communication, and when the piston 10 is stopped at the position of the advancing end or the retreating end, the main stopping electromagnetic valve 23 is switched to an OFF state as illustrated in FIG. 2, and the air flow path 16 is blocked. This results in sealing the air in the pressure chamber 11 of the main cylinder 2. Thereby, an operation for retaining the main cylinder 2 at the stopping position is further stably performed.

Incidentally, since the construction of the second embodiment other than that described above is substantially the same as that of the first embodiment, the same numerals as that of the first embodiment are attached to the same main components, and the explanation for the construction and the operation is omitted.

Figure 3:
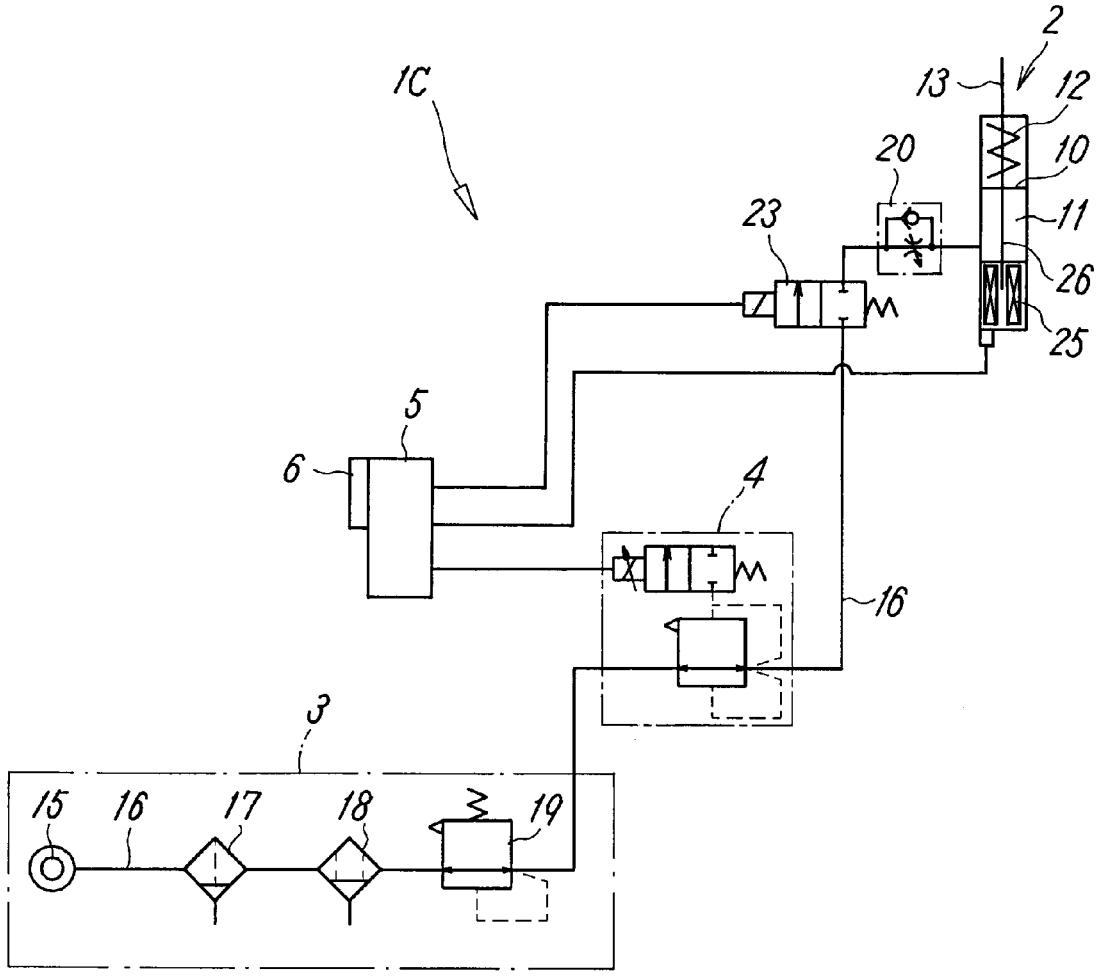
FIG. 3 is a hookup drawing illustrating a third embodiment of a positioning control mechanism according to the present invention.

In FIG. 3, a third embodiment of the positioning control mechanism according to the present invention is illustrated. A difference of the positioning control mechanism 1C of the third embodiment from the positioning control mechanism 1B of the second embodiment is that the main cylinder 2 is provided with a length-measuring sensor 25 for detecting the movement position of the piston 10.

The length-measuring sensor 25 is configured to measure the movement position of the piston 10 over an entire stroke thereof by detecting a displacement of the length-measuring rod 26 that is attached to the piston 10 and displaced together with the piston 10. The length-measuring sensor 25 is electrically connected to the controller 5 and a measurement signal obtained by means of the length-measuring sensor 25 is configured to be fed back to the controller 5.

The measurement of the displacement of the length-measuring rod 26 is performed by magnetically, electrically, or optically reading a scale attached to the length-measuring rod 26 by means of the length-measuring sensor 25. However, the measurement is not limited to the method using such a length-measuring rod 26 but measuring methods other than the above-described may be used.

The measurement signal fed back from the length-measuring sensor 25 to the controller 5 is used for confirmation of the movement position of the piston 10, the control for other control devices relating to the positioning control, and so forth. Alternatively, the measurement signal can be used for controlling the automatic pressure-adjusting valve 4. Positioning accuracy can further be raised by controlling the automatic pressure-adjusting valve 4 using the measured position information together, which is obtained by means of the length-measuring sensor 25.

Incidentally, the length-measuring sensor 25 can be applied to the positioning control mechanism 1A of the first embodiment.

Figure 4:
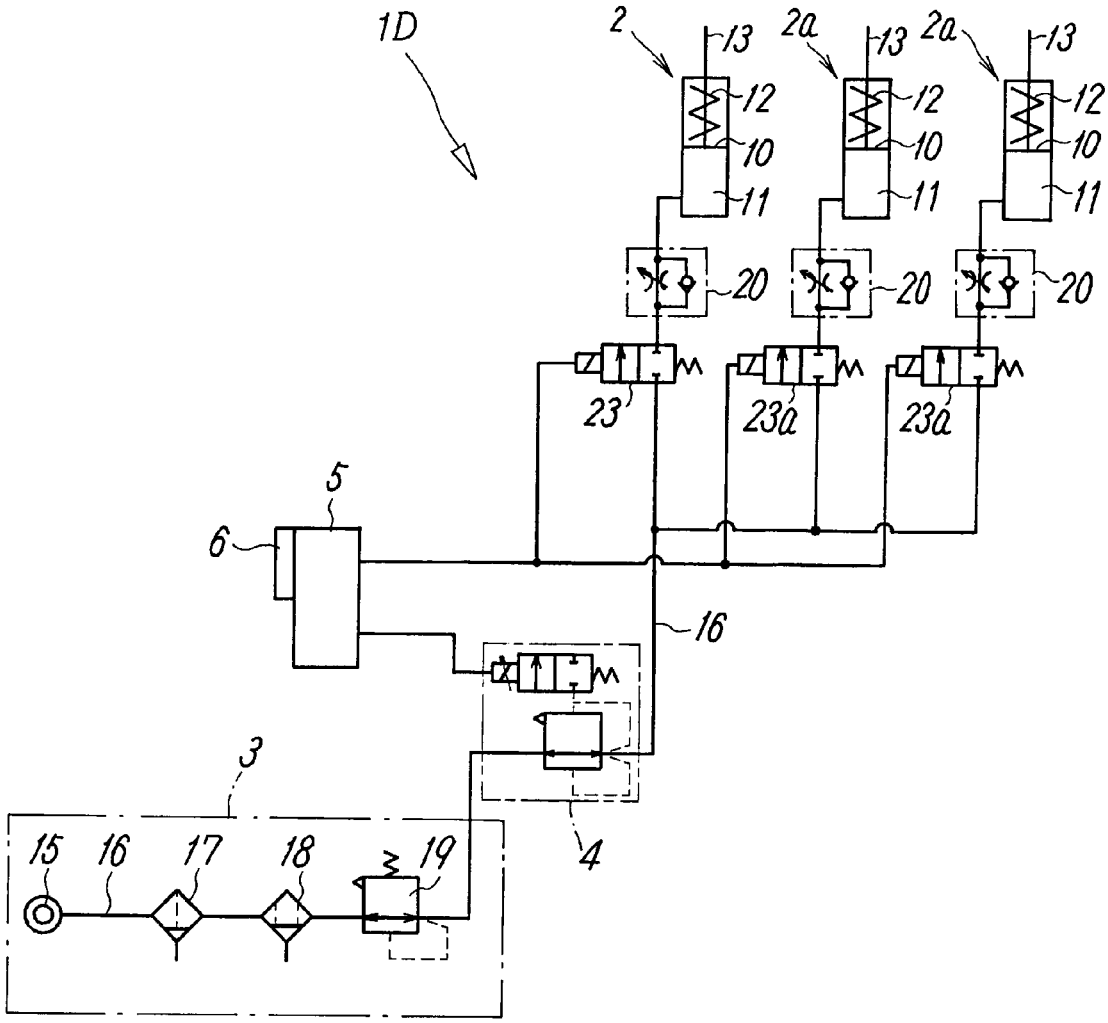
FIG. 4 is a hookup drawing illustrating a fourth embodiment of a positioning control mechanism according to the present invention.

A fourth embodiment of the positioning control mechanism according to the present invention is illustrated in FIG. 4. A positioning control mechanism 1D of the fourth embodiment has a construction where a pair or more of slave cylinders 2*a* and a pair or more of slave stopping electromagnetic valves 23*a* are connected to the pressure-adjusting apparatus 4 and the controller 5 in parallel with the main cylinder 2 and the main stopping electromagnetic valve 23 in the positioning control mechanism 1B of the second embodiment. These slave cylinders 2*a* and the slave stopping electromagnetic valves 23*a* have the same construction as that of the main cylinder 2 and the main stopping electromagnetic valve 23.

Incidentally, since the construction of the fourth embodiment other than that described above is substantially the same as that of the second embodiment, the same numerals as that of the second embodiment are attached to the same main components and the explanation for the construction and the operation is omitted.

In the fourth embodiment, the slave cylinder 2*a* and the slave stopping electromagnetic valve 23*a* are position-controlled in the same manner as that of the main cylinder 2 and the main stopping electromagnetic valve 23 while synchronizing therewith by means of the controller 5 and one pressure-adjusting apparatus 4. However, in the fourth embodiment, the main stopping electromagnetic valve 23 and the slave stopping electromagnetic valves 23*a* can also be omitted.

Figure 5:
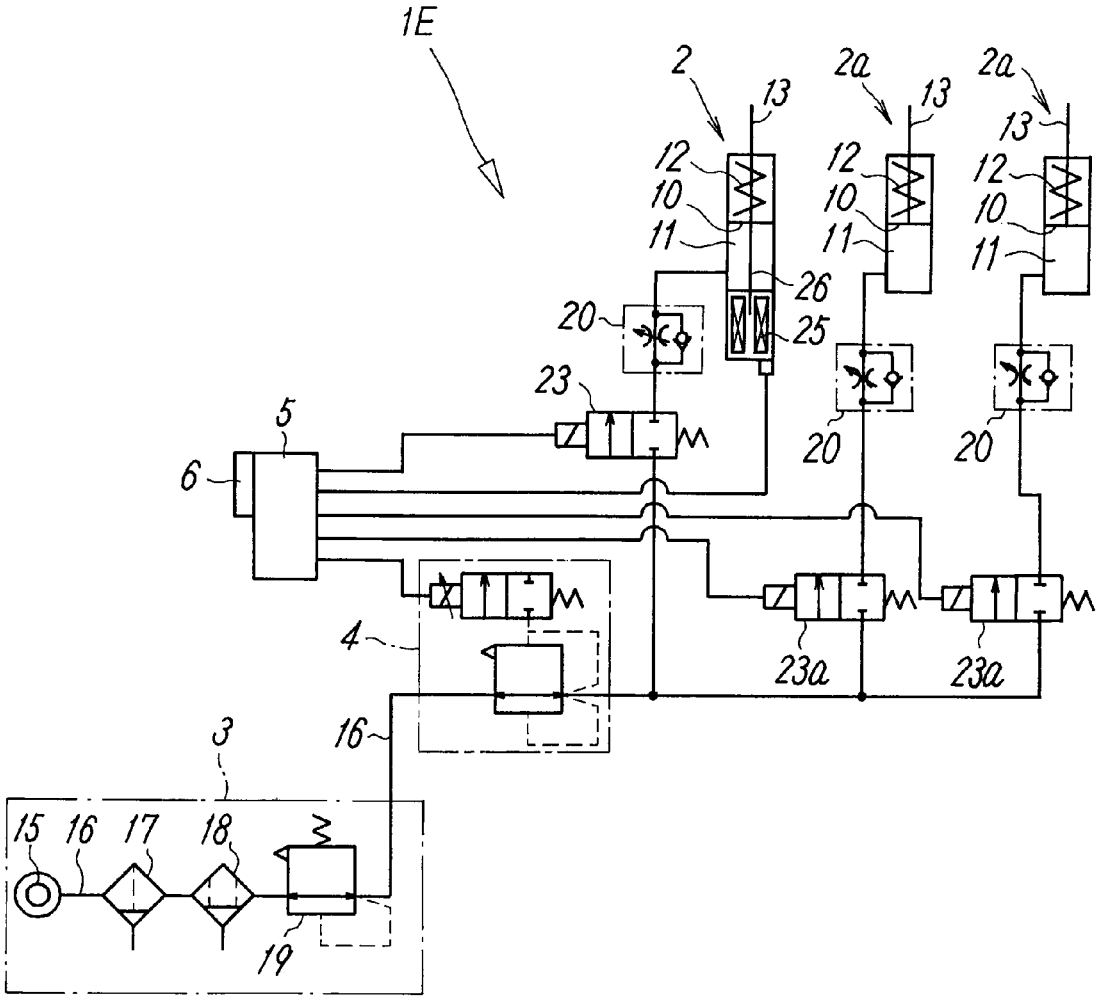
FIG. 5 is a hookup drawing illustrating a fifth embodiment of a positioning control mechanism according to the present invention.

In FIG. 5, a fifth embodiment of the positioning control mechanism according to the present invention is illustrated. A positioning control mechanism 1E in the fifth embodiment is provided with a construction where a pair or more of the slave cylinders 2*a* and a pair or more of the slave stopping electromagnetic valves 23*a* are connected to the pressure-adjusting apparatus 4 and the controller 5 in parallel with the main cylinder 2 and the main stopping electromagnetic valve 23 in the positioning control mechanism 1C of the third embodiment.

The slave cylinder 2*a* is provided with the same construction as that of the main cylinder 2 except that the slave cylinder 2*a* does not includes the length-measuring sensor 25 and the length-measuring rod 26.

Since the construction of the fifth embodiment other than that described above is substantially the same as that of the third embodiment, the same numerals as that of the third embodiment are attached to the same main components and the explanation for the construction is omitted.

In the fifth embodiment, the slave cylinder 2*a* and the slave stopping electromagnetic valve 23*a* are position-controlled in the same manner as that of the main cylinder 2 and the main stopping electromagnetic valve 23 while synchronizing therewith by means of the controller 5 and one pressure-adjusting apparatus 4. However, in the fifth embodiment, the main stopping electromagnetic valve 23 and the slave stopping electromagnetic valves 23*a* can also be omitted.

Figure 6:
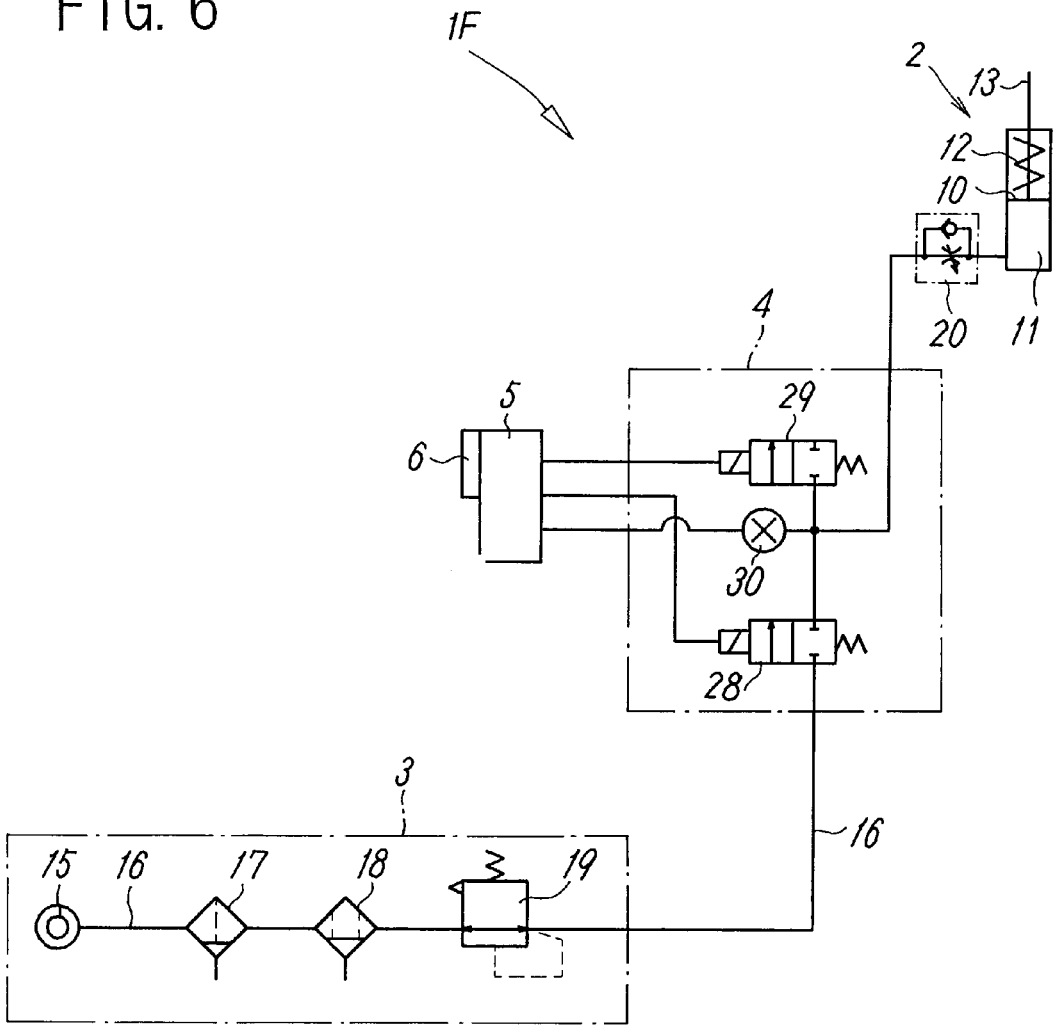
FIG. 6 is a hookup drawing illustrating a sixth embodiment of a positioning control mechanism according to the present invention.

In FIG. 6, a sixth embodiment of the positioning control mechanism according to the present invention is illustrated. A construction of the pressure-adjusting apparatus 4 of the positioning control mechanism 1F of the sixth embodiment is different from that of the positioning control mechanism 1A of the first embodiment. That is, the pressure-adjusting apparatus 4 of the sixth embodiment is composed of a two-port-type supplying electromagnetic valve 28 for either allowing the air to pass through the air flow path 16 or not while being connected in the air flow path 16 that connects the air-supplying unit 3 and the pressure chamber 11, a two-port-type exhausting electromagnetic valve 29 for either allowing the air to pass through or not between the pressure chamber 11 and the atmospheric air, and a pressure sensor 30 for detecting the air pressure in the pressure chamber 11. The supplying electromagnetic valve 28, the exhausting electromagnetic valve 29, and the pressure sensor 30 are electrically connected to the controller 5.

In the same manner as the case of the first embodiment, the controller 5 is constructed to be provided with the input device 6 for inputting the target position of the movement of the piston 10, and to obtain the relationship between the air pressure and the position of the piston 10 from the relationship between the position of the piston 10 and the spring force of the return spring 12, and the relationship between the air pressure supplied to the pressure chamber 11 and the acting force applied to the piston 10. However, the difference of the case of the sixth embodiment from that of the first embodiment is that the air pressure in the pressure chamber 11 is adjusted by performing an on/off control for the supplying electromagnetic valve 28 and the exhausting electromagnetic valve 29 so that the air pressure in the pressure chamber 11 detected by means of the pressure sensor 30 is adjusted to the pressure corresponding to the target position of the movement of the piston 10, and thereby the piston 10 is moved toward the target position and stopped at the position.

Namely, when the positions of the advancing end and the retreating end of the piston 10 is inputted as the target position by means of the input device 6, the piston 10 is moved between the two positions above, however in the advancing process of the piston 10, the supplying electromagnetic valve 28 is switched to an ON state by the controller 5, and thereby the pressure chamber 11 of the main cylinder 2 is allowed to communicate with the air-supplying unit 3, and the exhausting electromagnetic valve 29 is switched to an OFF state, and thereby the pressure chamber 11 is blocked from the atmospheric air. Thereby, the air is supplied from the air-supplying unit 3 into the pressure chamber 11, and the piston 10 and the rod 13 advance while compressing the return spring 12.

A variation of the air pressure in the pressure chamber 11 is constantly measured by means of the pressure sensor 30, and when the air pressure reaches the pressure corresponding to the target position of the movement of the piston 10, the supplying electromagnetic valve 28 is switched to an OFF state by means of the controller 5, and the air is sealed in the pressure chamber 11. Thereby, the piston 10 is stopped at the position and is retained at the stopping state.

Further, in the retreating process where the piston 10 retreats from the advancing end, the supplying electromagnetic valve 28 is switched to the OFF state and the exhausting electromagnetic valve 29 is switched to the ON state, and thereby the pressure chamber 11 is opened to the atmospheric air. Consequently, the piston 10 and the rod 13 retreat by means of the spring force of the return spring 12. Furthermore, when the air pressure in the pressure chamber 11 reaches the pressure corresponding to the position of the retreating end of the piston 10, the exhausting electromagnetic valve 29 is switched to the OFF state by means of the controller 5, and the air is sealed in the pressure chamber 11. Thereby, the piston 10 is stopped at the position and is retained at the stopping state.

Incidentally, since the construction of the sixth embodiment other than that described above is substantially the same as that of the first embodiment, the same numerals as that of the first embodiment are attached to the same main components and the explanation for the construction and the operation is omitted.

In the sixth embodiment, the length-measuring sensor 25 such as that used in the third embodiment illustrated in FIG. 3 is also provided in the main cylinder 2, and the length-measuring sensor 25 can be used for confirmation of the movement position of the piston 10, the control for the pressure-adjusting apparatus 4, the control for other control devices relating to the positioning control, and so forth on the basis of the measurement signal fed back from the length-measuring sensor 25 to the controller 5.

Moreover, the sixth embodiment can also be constructed such that the slave cylinder 2*a* as in the fourth and fifth embodiments is provided in parallel with the main cylinder 2, and that the slave cylinder 2*a* is position-controlled in the same manner as that of the main cylinder 2 while synchronizing therewith by means of the supplying electromagnetic valve 28 and the exhausting electromagnetic valve 29 of the pressure-adjusting apparatus 4 for use in the main cylinder 2. In this case, a pressure-adjusting apparatus for use in the slave cylinder that is composed of the supplying electromagnetic valve 28 and the exhausting electromagnetic valve 29 in a similar manner as that of the pressure-adjusting apparatus 4 for use in the main cylinder 2 can be connected between the slave cylinder 2*a* and the air-supplying unit 3, and the slave cylinder 2*a* and the controller 5, respectively.

In each of the embodiments, although the main stopping electromagnetic valve 23, the slave stopping electromagnetic valve 23*a*, the supplying electromagnetic valve 28, and the exhausting electromagnetic valve 29 may be installed at separate positions from the main cylinder 2 or the slave cylinder 2*a*, respectively, the same may be respectively mounted on the corresponding main cylinder 2 or the slave cylinder 2*a*. In addition, the controller 5 can be assembled with the main cylinder 2. Further, in a case that the speed controller 20 is provided, the same can be assembled with the corresponding main cylinder 2 or the slave cylinder 2*a*.

The invention claimed is:

1. A positioning control mechanism for a single-acting air cylinder comprising:

a single-acting main cylinder wherein a pressure chamber and a return spring are provided at either side of a piston, and the piston is moved by means of air pressure supplied to the pressure chamber and a spring force of the return spring;

an air-supplying unit including an air source;

a pressure-adjusting apparatus disposed between the air-supplying unit and the pressure chamber of the single-acting main cylinder; and a controller for electrically controlling the pressure-adjusting apparatus, wherein the pressure-adjusting apparatus is formed of an electromagnetic operation-type automatic pressure-adjusting valve outputting the air pressure corresponding to an amount of electric power, wherein the controller includes an input device for inputting a target position of a movement of the piston, and is configured to obtain a relationship between a position of the piston and the air pressure from a relationship between the position of the piston and the spring force of the return spring and a relationship between the air pressure supplied to the pressure chamber and an acting force applied to the piston by means of the air pressure, and when the target position of the movement of the piston is inputted by means of the input device, the controller is operated to move the piston toward the target position and to stop the piston at the position by controlling the amount of electric power for the automatic pressure-adjusting valve so that the air pressure corresponding to the target position is outputted.

2. The positioning control mechanism for the single-acting air cylinder according to claim 1, wherein a two-port-type main stopping electromagnetic valve is connected in an air flow path connecting the pressure-adjusting apparatus and the pressure chamber of the main cylinder, and the main stopping electromagnetic valve is on/off-controlled by means of the controller, and the main stopping electromagnetic valve is operated such that when the piston is moving, the main stopping electromagnetic valve is switched to an ON state and opens the air flow path, and when the piston is stopped, the main stopping electromagnetic valve is switched to an OFF state and seals the air in the pressure chamber.

3. The positioning control mechanism for a single-acting air cylinder according to claim 1, wherein the main cylinder includes a length-measuring sensor measuring a movement position of the piston and feeding back a position signal to the controller.

4. The positioning control mechanism for a single-acting air cylinder according to claim 2, wherein the main cylinder includes a length-measuring sensor measuring a movement position of the piston and feeding back a position signal to the controller.

5. The positioning control mechanism for a single-acting air cylinder according to claim 1, wherein a single-acting slave cylinder connected to the pressure-adjusting apparatus in parallel with the main cylinder is provided, and the slave cylinder is position-controlled while synchronizing with the main cylinder by means of the controller via the pressure-adjusting apparatus.

6. The positioning control mechanism for a single-acting air cylinder according to claim 2, wherein a single-acting slave cylinder connected to the pressure-adjusting apparatus in parallel with the main cylinder is provided, and the slave cylinder is position-controlled while synchronizing with the main cylinder by means of the controller via the pressure-adjusting apparatus.

7. The positioning control mechanism for a single-acting air cylinder according to claim 3, wherein a single-acting slave cylinder connected to the pressure-adjusting apparatus in parallel with the main cylinder is provided, and the slave cylinder is position-controlled while synchronizing with the main cylinder by means of the controller via the pressure-adjusting apparatus.

8. The positioning control mechanism for a single-acting air cylinder according to claim 4, wherein a single-acting slave cylinder connected to the pressure-adjusting apparatus in parallel with the main cylinder is provided, and the slave cylinder is position-controlled while synchronizing with the main cylinder by means of the controller via the pressure-adjusting apparatus.

9. The positioning control mechanism for the single-acting air cylinder according to claim 6, wherein a two-port-type slave stopping electromagnetic valve is connected in the air flow path connecting the pressure-adjusting apparatus and the pressure cylinder of the slave cylinder, and the two-port-type slave stopping electromagnetic valve is controlled by means of the controller while synchronizing with the main stopping electromagnetic valve.

10. The positioning control mechanism for the single-acting air cylinder according to claim 8, wherein a two-port-type slave stopping electromagnetic valve is connected in the air flow path connecting the pressure-adjusting apparatus and the pressure cylinder of the slave cylinder, and the two-port-type slave stopping electromagnetic valve is controlled by means of the controller while synchronizing with the main stopping electromagnetic valve.

11. The positioning control mechanism for the single-acting air cylinder according to claim 1, wherein the air-supplying unit includes a regulator for maintaining the air pressure at a set pressure.

12. The positioning control mechanism for the single-acting air cylinder according to claim 2, wherein the air-supplying unit includes a regulator for maintaining the air pressure at a set pressure.

* * * * *